US010006458B2

(12) United States Patent
Yoon

(10) Patent No.: US 10,006,458 B2
(45) Date of Patent: Jun. 26, 2018

(54) ELECTRIC GEAR PUMP WITH SPECIFIC PROPORTIONS FOR THE FLUID PASSAGES

(71) Applicant: LG INNOTEK CO., LTD., Seoul (KR)

(72) Inventor: Ho Eop Yoon, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 410 days.

(21) Appl. No.: 14/626,974

(22) Filed: Feb. 20, 2015

(65) Prior Publication Data

US 2015/0240813 A1 Aug. 27, 2015

(30) Foreign Application Priority Data

Feb. 21, 2014 (KR) ..... 10-2014-0020284

(51) Int. Cl.

| | |
|---|---|
| ***F04C 15/00*** | (2006.01) |
| ***F01C 21/10*** | (2006.01) |
| ***F04C 2/10*** | (2006.01) |
| ***F04C 15/06*** | (2006.01) |

(52) U.S. Cl.

CPC ..... *F04C 15/06* (2013.01); *F01C 21/10* (2013.01); *F04C 2/10* (2013.01); *F04C 2/102* (2013.01); *F04C 15/008* (2013.01); *F04C 2250/10* (2013.01); *F04C 2250/101* (2013.01); *F04C 2250/102* (2013.01)

(58) Field of Classification Search

CPC .... F04C 2/08; F04C 2/088; F04C 2/10; F04C 2/012; F04C 2/102; F04C 15/06; F04C 2/008; F04C 2/101; F04C 2/103; F04C 2250/102; F01C 21/10

See application file for complete search history.

(56) References Cited

U.S. PATENT DOCUMENTS

| | | | | |
|---|---|---|---|---|
| 2001/0016173 | A1 | 8/2001 | Watanabe et al. | |
| 2004/0022660 | A1 | 2/2004 | Eisenmann et al. | |
| 2004/0191101 | A1* | 9/2004 | Ogata | F04C 2/084 418/171 |

(Continued)

FOREIGN PATENT DOCUMENTS

WO WO 2009/149682 12/2009

OTHER PUBLICATIONS

European Search Report dated Apr. 4, 2018 issued in Application No. 15155864.0.

*Primary Examiner* — Devon Kramer
*Assistant Examiner* — Christopher Brunjes
(74) *Attorney, Agent, or Firm* — KED & Associates, LLP

(57) ABSTRACT

The electric pump of the present application includes a motor unit including a stator, a rotor core disposed inside the stator and a shaft coupled to the rotor core; a pump unit including an internal rotor coupled to the shaft and having an external lob formed thereon and an external rotor disposed outside the internal rotor and having an internal lob formed to be engaged with the external lob; a housing unit including a motor housing including the motor unit and a pump housing connected to the motor housing and having a pump accommodating part, in which the pump unit is inserted, formed therein; and a cover unit coupled to the housing unit to cover the pump accommodating part.

7 Claims, 9 Drawing Sheets

(56) References Cited

U.S. PATENT DOCUMENTS

| | | | | |
|---|---|---|---|---|
| 2006/0067849 | A1* | 3/2006 | Kimura | F04C 2/084 418/61.3 |
| 2007/0183916 | A1* | 8/2007 | Kim | F04C 18/0215 418/55.6 |
| 2010/0040488 | A1* | 2/2010 | Yukitake | H02K 1/02 417/410.1 |
| 2012/0128513 | A1* | 5/2012 | Sakata | F04C 2/086 417/410.1 |
| 2012/0148426 | A1* | 6/2012 | Bodzak | F04C 2/086 417/410.4 |

* cited by examiner

ELECTRIC GEAR PUMP WITH SPECIFIC PROPORTIONS FOR THE FLUID PASSAGES

CROSS-REFERENCE TO RELATED APPLICATION

This application claims priority under 35 U.S.C. § 119 to Korean Application No. 10-2014-0020284 filed on Feb. 21, 2014, whose entire disclosure is incorporated herein by reference.

BACKGROUND

1. Field

The present application relates to an electric pump, and more particularly, to an electric pump pumping a fluid through a rotor rotated by a motor.

2. Background

In general, electric oil pumps (EOP) are devices for supplying, using a motor, oil to an oil pressure line in a transmission or a braking device of a vehicle in which an oil circulation is required.

In the case of hybrid electric vehicles (HEVs), since an engine is halted when a vehicle is not travelled, it is difficult to supply a predetermined pressure to a transmission through a mechanical oil pump. Due to this, an electric oil pump which supplies oil through a motor is used in the HEVs.

Torque of such an electric oil pump is generally classified into hydraulic torque due to a volume of a fluid and friction torque due to mechanical friction. Once the friction torque is increased, since a loss due to the friction should be compensated, additional power is required and electric power consumption of the electric oil pump is thus increased.

BRIEF DESCRIPTION OF THE DRAWINGS

The embodiments will be described in detail with reference to the following drawings in which like reference numerals refer to like elements wherein.

DETAILED DESCRIPTION

Hereinafter, exemplary embodiments of the present application will be described in detail with reference to the accompanying drawings. Objects, specific advantages and novel characteristics of the present applications will be more clearly understood from the following description and the preferred embodiments taken in conjunction with the accompanying drawings. And, the vocabularies or terminologies used in the detail description and claims shall not be interpreted as being limited to having a common or dictionary meaning, and shall be interpreted as having a meaning and concept suitable for the technical spirit of the present application based on the principle that the inventor can define a concept the terminology by himself/herself in order to describe his/her invention in the best manner. In the detail description describing the present application, in addition, the description on the related well-known technologies which would unnecessarily obscure the gist of present application will be omitted.

The terms including the ordinal numeral such as "first", "second", etc. may be used to describe various components, but the components are not limited by such terms. The terms are used only for the purpose of distinguishing one component from other components. For example, the second component may be designated as the first component without departing from the scope of the present application. In the same manner, the first component may be designated as the second component.

Figure 1:
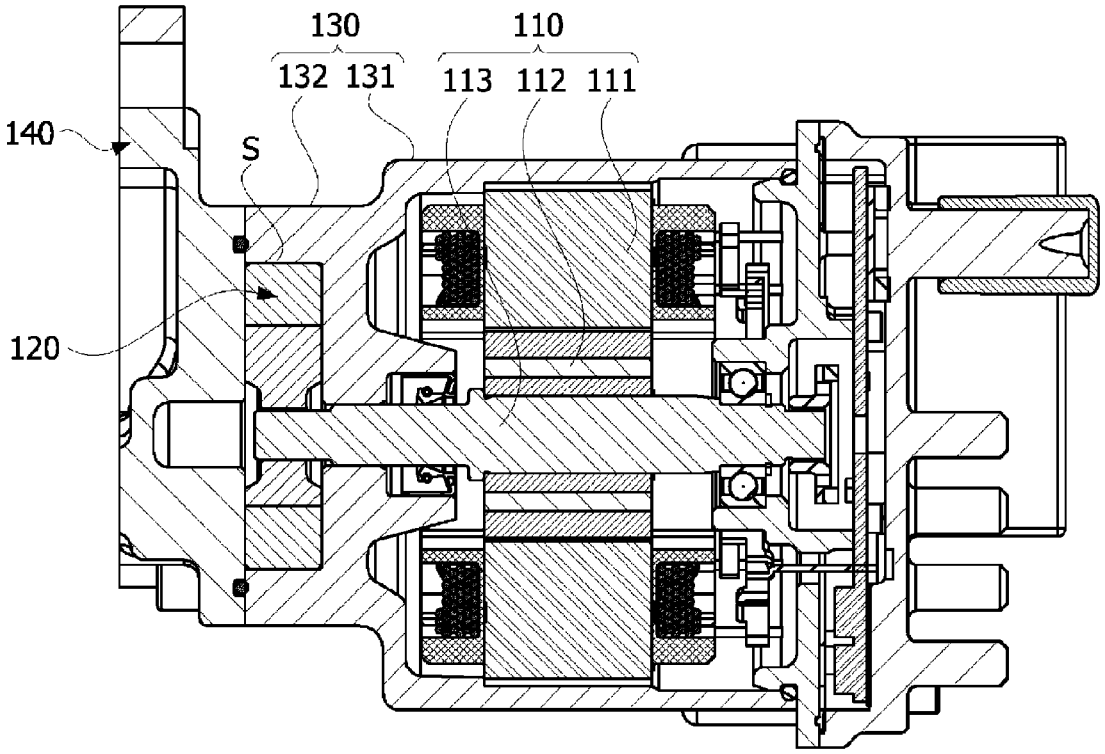
FIG. 1 is a view showing an electric pump according to one preferred embodiment of the present application.
Figure 2:
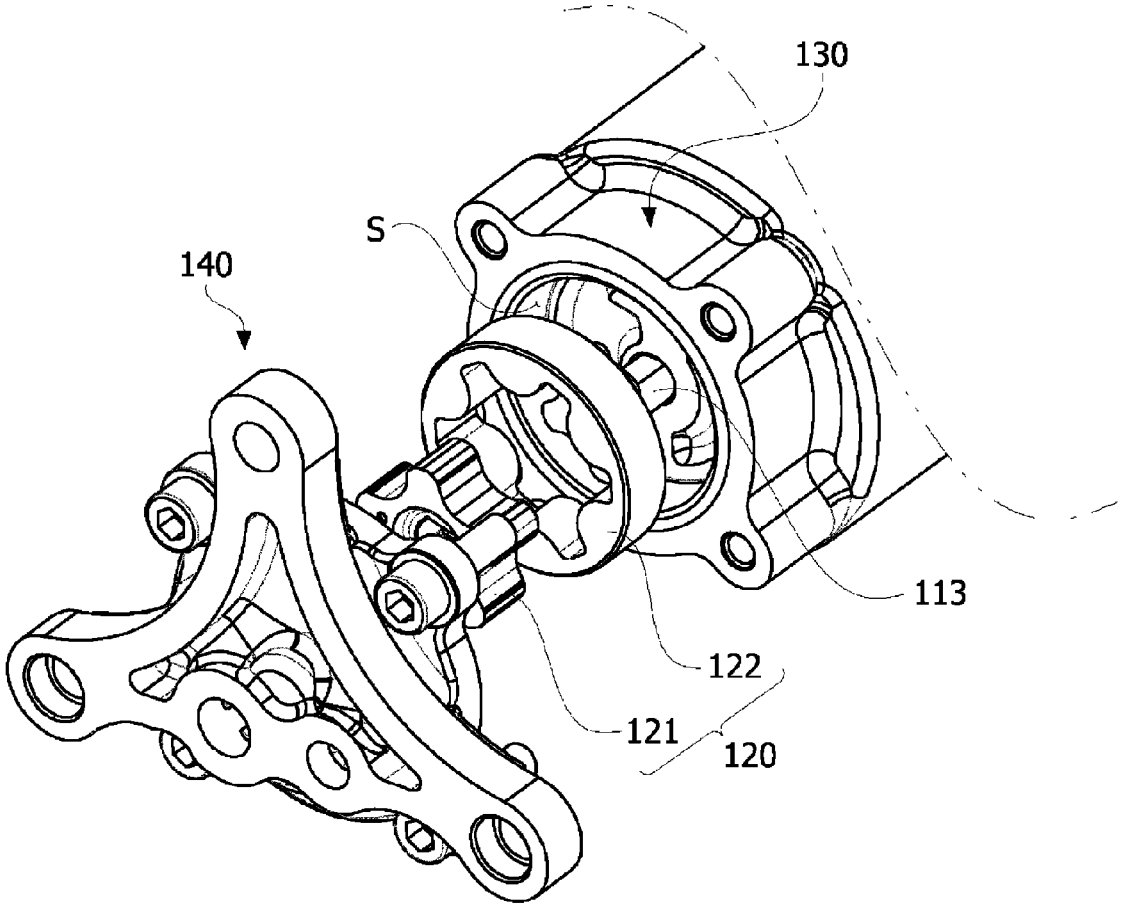
FIG. 2 is an exploded perspective view showing a pump unit shown in FIG. 1.

FIG. 1 is a view showing an electric pump according to one preferred embodiment of the present application and FIG. 2 is an exploded perspective view showing a pump unit shown in FIG. 1. FIG. 1 and FIG. 2 clearly show the main characterized parts of the present application in order to conceptually and clearly understand the present application. As a result, various modifications of the drawings are expected, and there is no need to limit a scope of the present application to the specific shape shown in the drawings.

Referring to FIG. 1 and FIG. 2 together, an electric pump according to one preferred embodiment of the present application may include a motor unit 110, a pump unit 120, a housing unit 130, and a cover unit 140.

The motor unit 110 provides the pump unit 120 with power and may include a stator 111, a rotor core 112 and a shaft 113.

The stator 111 may be installed along a circumference of the rotor core 112 with a gap formed therebetween. In addition, a coil generating a rotating magnetic field is wound around the stator 111 and induces an electrical interaction with the rotor core 112, thereby causing rotation of the rotor core 112. Once the rotor core 112 is rotated, the pump unit 120 with power while the shaft 113 is rotated. At this time, the shaft 113 may be configured to allow an end portion of the shaft to extend into a pump accommodating part S of the housing unit 130.

Meanwhile, the motor unit 110 may include an inverter and an inverter driving part. Also, a print circuit board mounted in the inverter may be directly connected to three-phase (U, V, W) terminals.

The pump unit 120 is inserted into a pump accommodating part S formed in the housing unit 130 so that power is transmitted from the motor unit 110 to the pump unit to allow the pump unit to pump oil. Such pump unit 120 may include an internal rotor 121 and an external rotor 122. The shaft 113 is fixedly inserted in a central portion of the internal rotor 121 to directly transmit the power from the motor unit 110 to the internal rotor.

The housing unit 130 may include a motor housing 131 (see FIG. 1) including the motor unit 110 and a pump housing 132 (see FIG. 1) forming the pump accommodating part S. The pump housing 132 may be aligned and disposed at a front end of the motor housing 131 so that and end portion of the shaft 113 is located at the pump accommodating part S. In addition, the motor housing 131 and the pump housing 132 may be just classified and described according to a functional characteristic, and the motor housing and the pump housing may be one means in which the two housings are integrally formed with and connected to each other.

Figure 3:
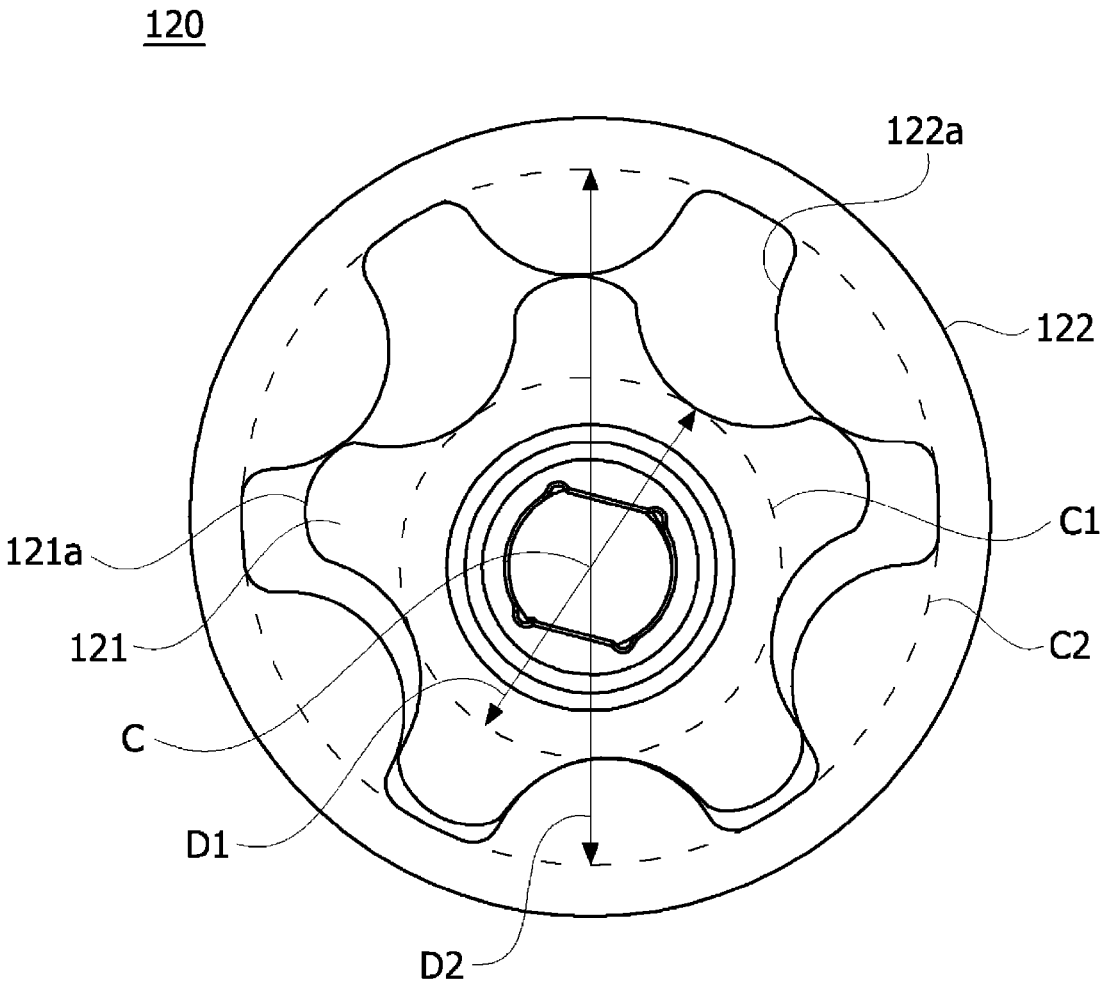
FIG. 3 is a view showing dedendum circles of an internal rotor and an external rotor shown in FIG. 2.

FIG. 3 is a view showing dedendum circles of the internal rotor and the external rotor shown in FIG. 2.

Referring to FIG. 3, the external rotor 122 is disposed outside the internal rotor 121. In addition, N external lobs 121*a* may be formed in the circumferential direction of the internal rotor 121, and each of the external lobs extends outward in the radial direction in the internal rotor with respect to a rotational center of the internal rotor. Meanwhile, N+1 internal lobs 122*a* may be formed in the external rotor 122, and each of the internal lobs extends inward in the radial direction in the external rotor. At this time, the internal rotor and the external rotor may be configured to allow the external lobs 121*a* to be engaged with the internal lobs 122*a*. According to rotation of the internal rotor 121, the external rotor 122 is rotated at a speed ratio of (N+1)/N.

When the internal rotor 121 is rotated, the pump unit 120 has a predetermined eccentric configuration, and a space through which the oil may be conveyed is formed between the internal rotor 121 and the external rotor 122 due to the above eccentric configuration. In other words, when the internal rotor 121 is rotated, a portion whose volume is increased sucks the ambient oil due to pressure drop and a portion whose volume is decreased discharges the oil due to a pressure increase. All the well-known structures may be applied as the above structure of the pump, the further detail description thereon is omitted.

Meanwhile, a diameter (hereinafter, referred to as D1) of a dedendum circle (hereinafter, referred to as C1) of the internal rotor 121 and a diameter (hereinafter, referred to as D2) of a dedendum circle (hereinafter, referred to as C2) of the external rotor 122 become a criteria for forming a pumping space.

Therefore, it is common that inner circumference surfaces 11 and 21 and outer circumference surfaces 12 and 22 of an inlet port 10 and an outlet port 20 formed in the cover unit 140 and the pump accommodating part S coincide with C1 and C2, respectively. In the present application, however, in order to reduce friction torque, the inlet port 10 is expanded to minimize a friction area of a front face of the internal rotor 121, a rear face of the external rotor 122, the pump accommodating part S, and the cover unit 140. This is because, unlike the outlet port 20, there is no need for the inlet port 10 to maintain a high pressure.

Figure 4:
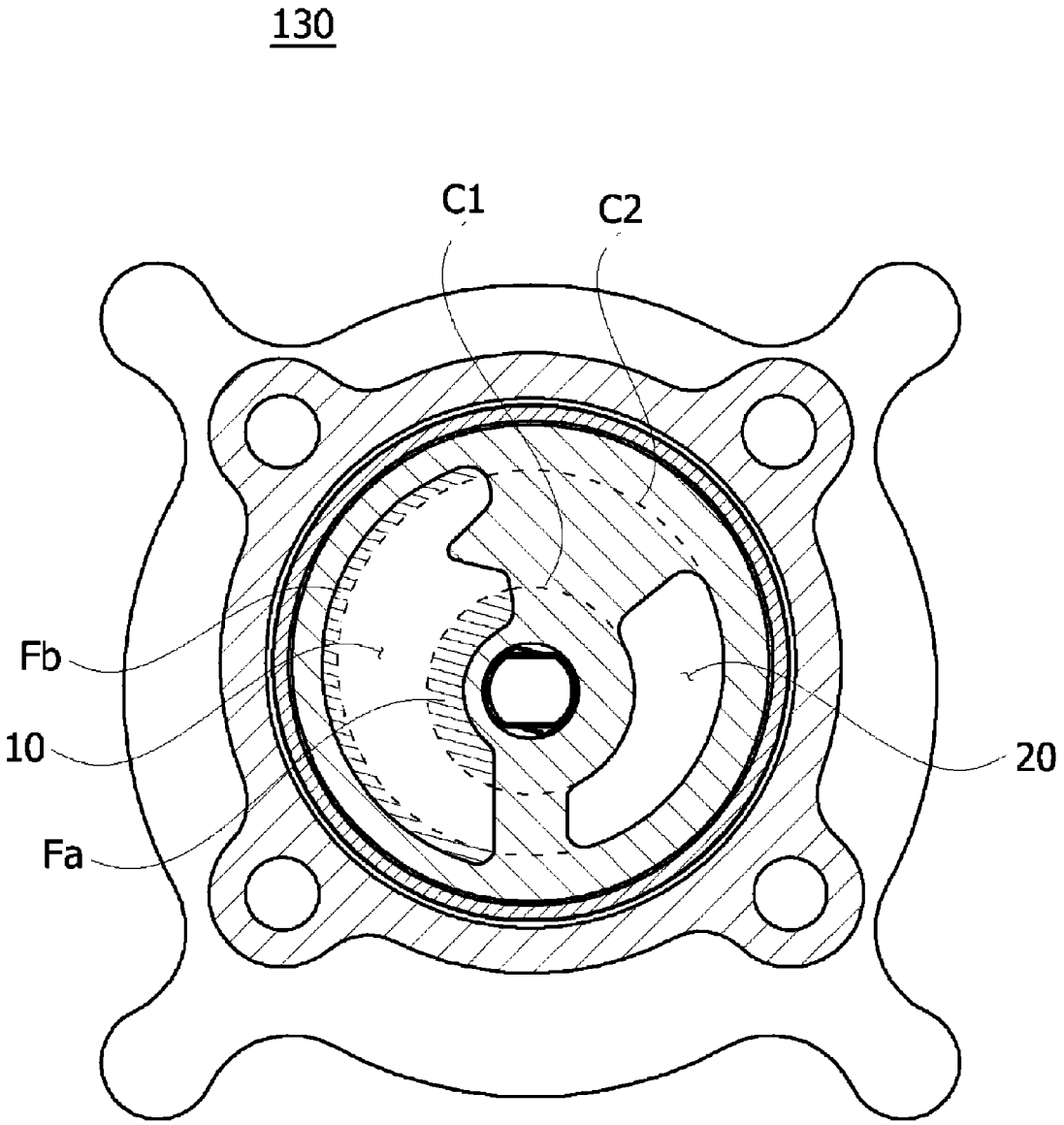
FIG. 4 is a view showing an expanded region of an inlet port formed in a pump accommodating part.
Figure 5:
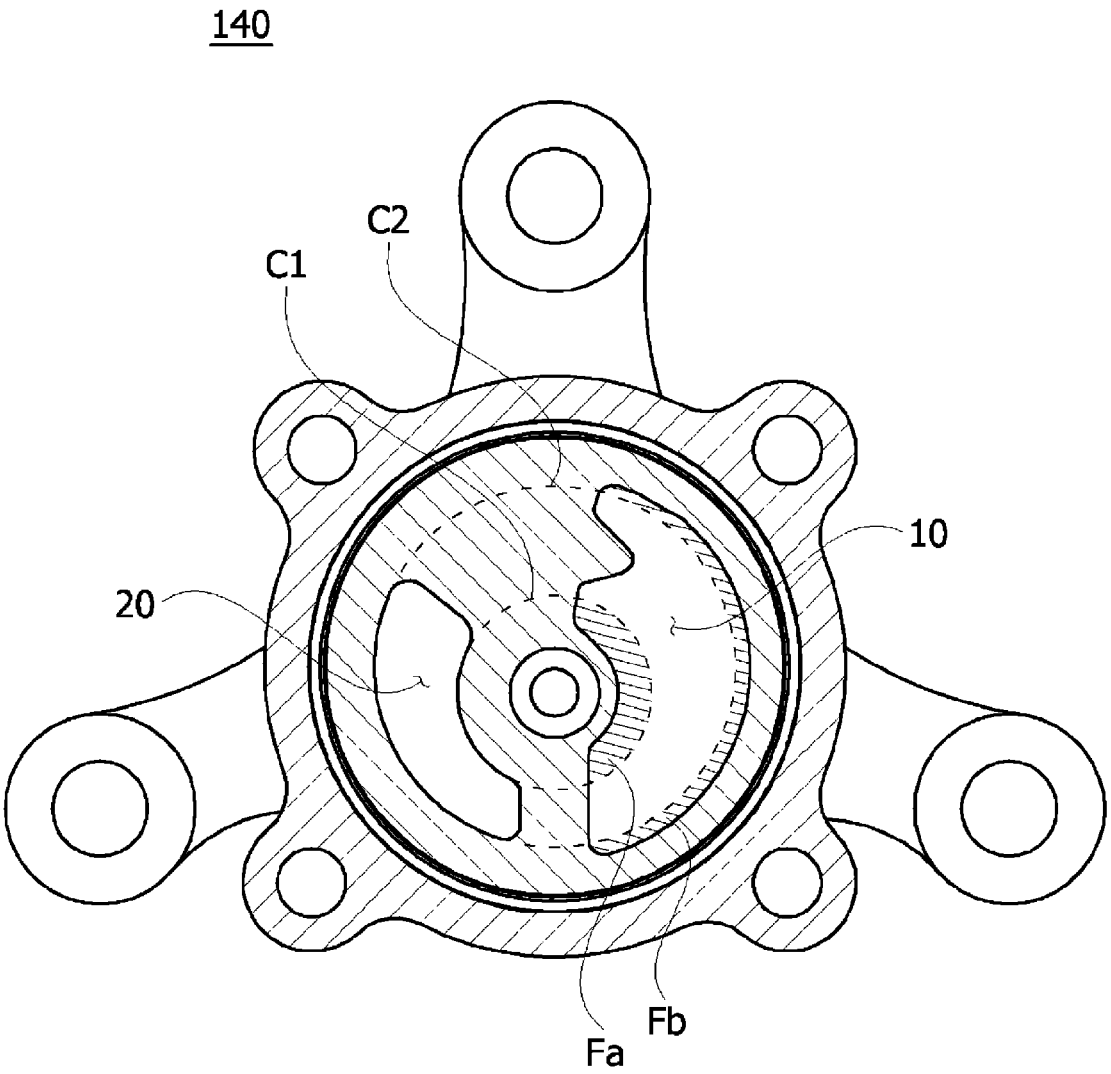
FIG. 5 is a view showing an expanded region of an inlet port formed in a cover unit.

FIG. 4 is a view showing the expanded region of the inlet port formed in the pump accommodating part and FIG. 5 is a view showing the expanded region of the inlet port formed in the cover unit.

The inlet port 10 and the outlet port 20 are formed in the housing unit 130 and the cover unit 140, respectively, to guide a fluid to enable the fluid to be smoothly entered and discharged by the pump unit 120. The inlet port 10 and the outlet port 20 as described above are spatially separated from each other to prevent a flow of a fluid due to a pressure difference. At this time, a friction lose is generated on a contact portion of the pump unit 120, the housing unit 130 and the cover unit 140. Therefore, the friction torque is increased in proportion to the contact area of the pump unit 120, the housing unit 130, and the cover unit 140.

In order to reduce the contact area of the pump unit 120, the housing unit 130, and the cover unit 140, in the present application, as shown in FIG. 4, an original region of the inlet port 10 formed in the housing unit 130 may be additionally expanded by a region represented by "Fa" in FIG. 4. In addition, it is possible to additionally expand the original region of the inlet port 10 by a region represented by "Fb" in FIG. 4.

As shown in FIG. 5, in addition, the original region of the inlet port 10 formed in the cover unit 140 may be additionally expanded by the region represented by "Fa" in FIG. 5. Also, it is possible to additionally expand the original region of the inlet port 10 by the region represented by "Fb" in FIG. 5.

Figure 6:
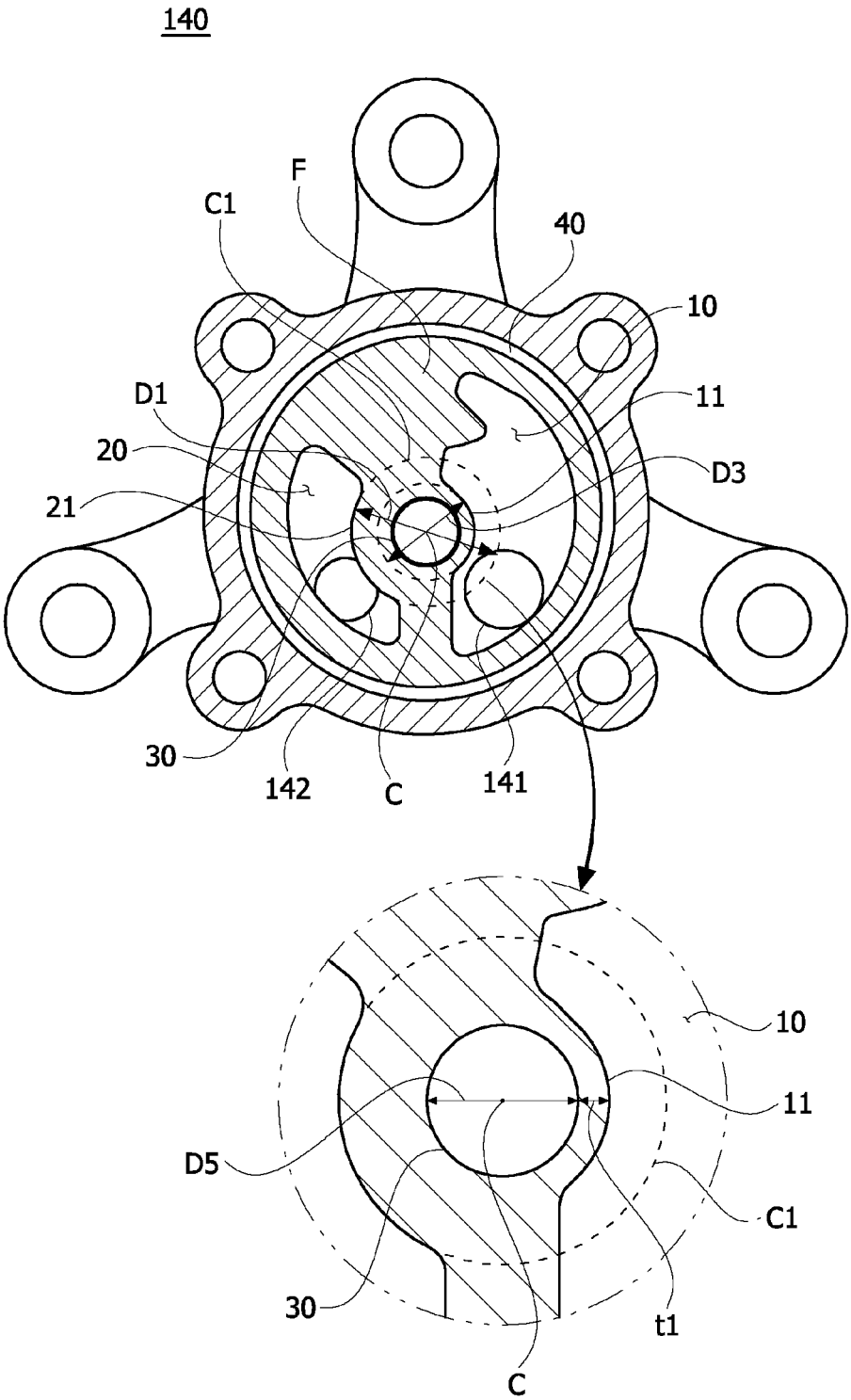
FIG. 6 is a view showing an inner diameter of an inlet port formed in a pump accommodating part.
Figure 7:
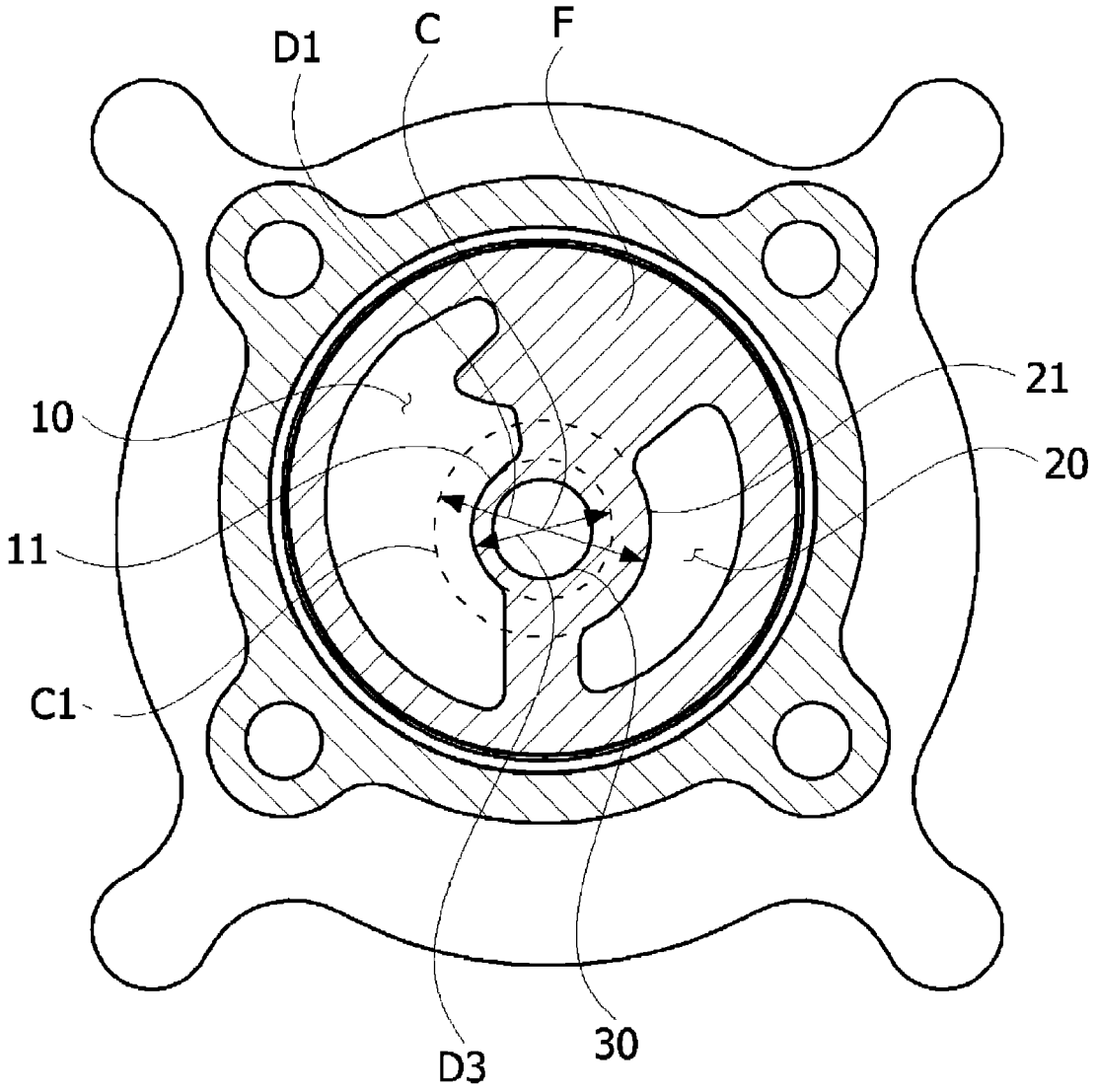
FIG. 7 is a view showing an inner diameter of an inlet port formed in a cover unit.

FIG. 6 is a view showing an inner diameter of the inlet port formed in the pump accommodating part, and FIG. 7 is a view showing an inner diameter of the inlet port formed in the cover unit.

A criterion of the expanded region Fa formed inward in the inner circumference surface of the inlet port 10 will be described in detail with reference to FIG. 6 and FIG. 7.

Referring to FIG. 6 and FIG. 7, the inlet port 10 may be formed in the housing unit 130 and the cover unit 140 in the radial direction and may be limited by an inner circumference surface and an outer circumference surface acting as a boundary. At this time, an inner diameter (hereinafter, referred to as "D3") of the inlet port 10, which is based on an inner circumference surface 11, may be less than D1 of C1.

Preferably, assuming that a distance in the radial direction between a shaft hole 30 formed on the central portion of the housing unit 130 for allowing the shaft 113 to pass therethrough and the inner circumference surface 11 of the inlet port 10 is a thickness (hereinafter referred to as "t1") of an inner wall, D3 may be configured to allow t1 to become 15% to 25% of a diameter of the shaft hole 30. Its purpose is to allow the inlet port 10 to be maximally expanded inward and to secure a structural strength for supporting the shaft 113.

Figure 8:
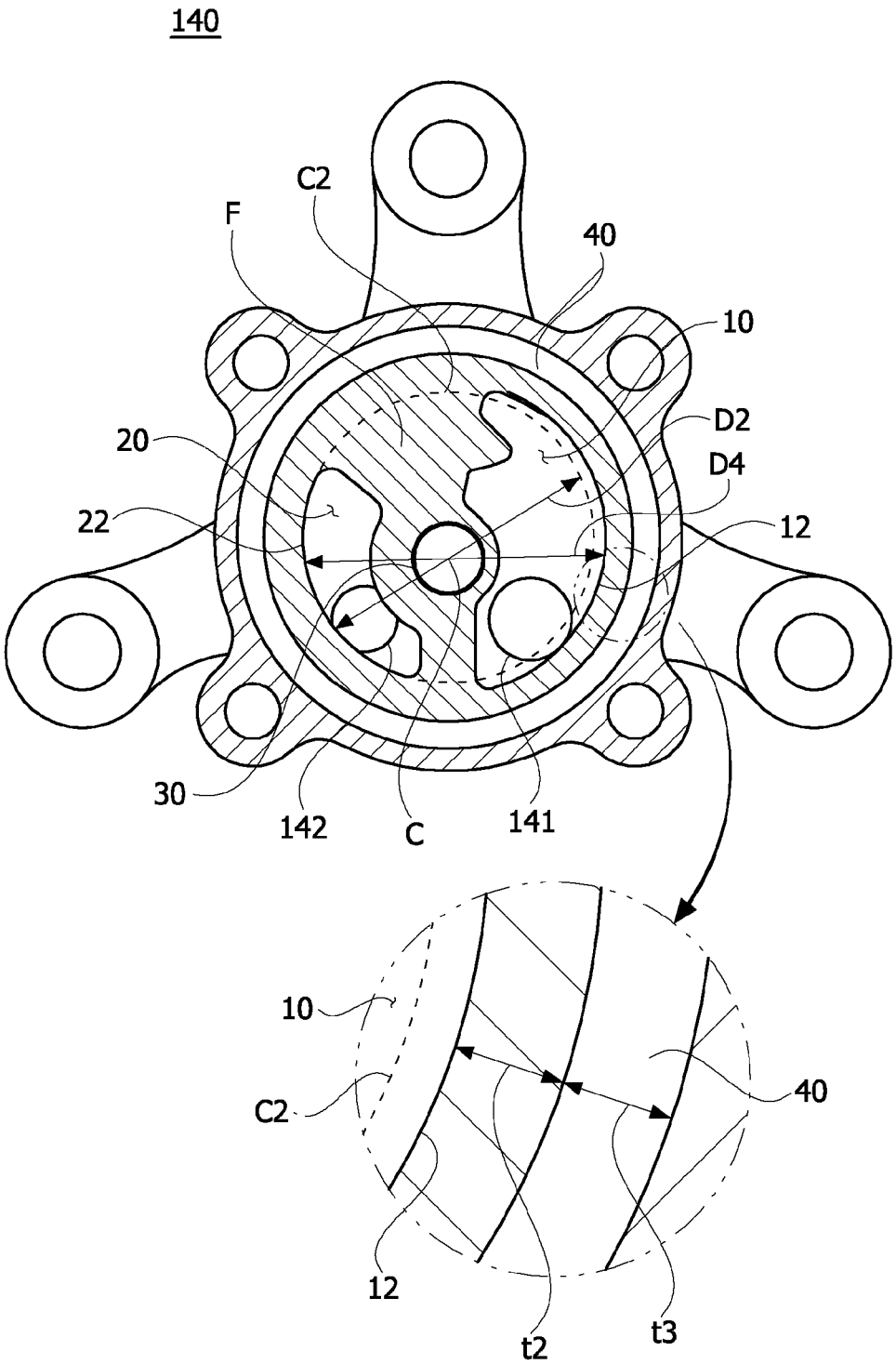
FIG. 8 is a view showing an outer diameter of an inlet port formed in a pump accommodating part.
Figure 9:
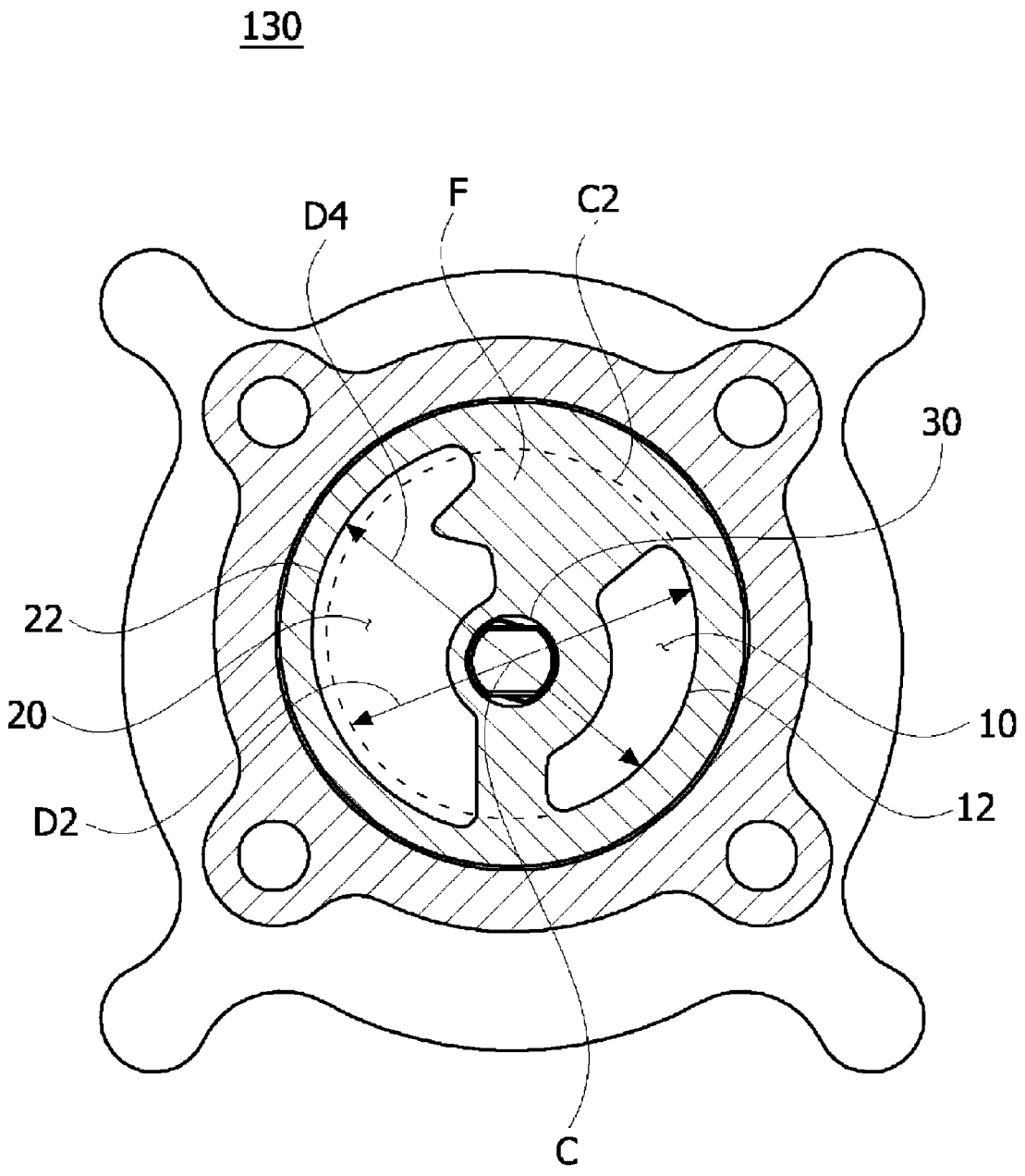
FIG. 9 is a view showing an outer diameter of an inlet port formed in a cover unit.

FIG. 8 is a view showing an outer diameter of the inlet port formed in the pump accommodating part, and FIG. 9 is a view showing an outer diameter of the inlet port formed in the cover unit.

A criterion of the expanded region Fb formed outward from an outer circumference surface of the inlet port 10 will be described in detail with reference to FIG. 8 and FIG. 9.

Referring to FIG. 8 and FIG. 9, the inlet port 10 may be configured such that an outer diameter (hereinafter referred to as "D4") of the inlet port 10, which is based on an outer circumference surface 12, may be greater than D2 of C2.

Preferably, an oil ring groove 40 in which an oil ring is inserted is formed in the cover unit 140 in the circumferential direction. Assuming that a distance in the radial direction between the oil ring groove 40 and the outer circumference surface 12 of the inlet port 10 is a thickness (hereinafter referred to as "t2") of an outer wall, D4 may be configured to allow t2 to be the same as a thickness t4 of the oil ring groove 40.

In the cover unit 140, meanwhile, an inlet (141 in FIG. 6) communicated with the inlet port 10 may be formed and an outlet (142 in FIG. 6) communicated with the outlet port 20 may be formed. The inlet 141 and the outlet 142 may be configured to face the internal rotor 212 and the external rotor 122.

As the area of the inlet port 10 is expanded as described above, the friction region (F in FIG. 6 to FIG. 9) is reduced, so that it is possible to reduce the friction torque. As a result, the friction torque generated among the front face of the internal rotor, the rear face of the external rotor and the housing unit may be reduced to reduce electric power consumption of the electric pump without affecting the performance of the electric pump. Furthermore, it is possible to improve the fuel efficiency of the vehicle to which the present application is applied.

According to one embodiment of the present application, the friction area of the pump housing, the cover unit, the internal rotor, and the external rotor is reduced by expanding an area of the inlet port at which there is no need to maintain a high pressure. Therefore, the present application is advantageous in that the friction torque is reduced and the electric power consumption of the electric pump is reduced.

In the above, the electric pump according to one preferred embodiment of the present application was described in detail with reference to the accompanying drawings.

Therefore, the present application is invented to solve the above problems, an object of the present application is to provide an electric pump which can reduce friction torque. In particular, an object of the present application is to provide an electric pump which can reduce friction torque generated in a friction region of a pump housing and a rotor.

The task to be achieved by the present application is not limited to the above mentioned task, and another task which is not mentioned herein may be understood by one skilled in the art from the below description.

In order to achieve the above object, the present application may provide an electric pump including a motor unit including a stator, a rotor core disposed inside the stator and a shaft coupled to the rotor core; a pump unit including an internal rotor coupled to the shaft and having an external lob formed thereon and an external rotor disposed outside the internal rotor and having an internal lob formed to be engaged with the external lob; a housing unit including a motor housing including the motor unit and a pump housing connected to the motor housing and having a pump accommodating part, in which the pump unit is inserted, formed therein; and a cover unit coupled to the housing unit to cover the pump accommodating part wherein an inlet port and an outlet port are formed in the radial direction in a bottom face of the pump accommodating part and an inner face of the cover unit to be separated to each other using an inner circumference surface and an outer circumference surface acting as a boundary, an inner diameter of the inlet port based on the inner circumference surface is less than a diameter of a dedendum circle of the external lob, and an outer diameter of the inlet port based on the outer circumference surface is greater than a diameter of a dedendum circle of the internal lob.

Preferably, the motor housing and the pump housing may be integrally formed.

Preferably, the pump housing may include a shaft hole through which the shaft passes.

Preferably, a thickness of an inner wall formed from the shaft hole to an inner circumference surface of the inlet port may be 15% to 25% of a diameter of the shaft hole.

Preferably, the cover unit may include an oil ring groove in which an oil ring is inserted.

Preferably, a thickness of an outer wall formed from the oil ring groove to an outer circumference surface of the inlet port may be greater than or equal to a thickness of the oil ring groove.

Preferably, the cover unit may include an inlet communicating with the inlet port and an outlet communicating with the outlet port.

Preferably, the inlet and the outlet may face the internal rotor and the external rotor.

The above detail description merely describes an exemplary technical spirit of the present application, those skilled in the art will appreciate that various alterations, modifications, and substitutions are possible, without departing from the intrinsic characteristic of the invention. Therefore, the preferred embodiments disclosed in the present application and the accompanying drawings are not intended to limit, but to describe the spirit of the present application, and the scope of the technical spirit of present application is not limited to the above embodiment and the accompanying drawings. The protective scope of the present application should be interpreted by below claims, and all the technical spirits which are equivalent to claims should be interpreted as being included in the scope of the right of the present application.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An electric pump, comprising:

a motor including a stator, a rotor core disposed inside the stator, and a shaft coupled to the rotor core;

a pump including an internal rotor coupled to the shaft and having an external lob formed thereon, and an external rotor disposed outside the internal rotor and having an internal lob formed to be engaged with the external lob;

a housing including a motor housing including the motor and a pump housing connected to the motor housing and having a pump accommodating cavity, in which the pump is inserted, formed therein; and a cover coupled to the housing to cover the pump accommodating cavity, wherein an inlet port and an outlet port are formed in a bottom face of the pump accommodating cavity and an inner face of the cover, and the inlet port and the outlet port are separated from each other using an inner circumference surface and an outer circumference surface acting as a boundary in the radial direction, an inner diameter of the inlet port based on the inner circumference surface is less than a diameter of a dedendum circle of the internal lob, and an outer diameter of the inlet port based on the outer circumference surface is greater than a diameter of a dedendum circle of the external lob, wherein an inner diameter of the outlet port is the same as the diameter of the dedendum circle of the internal lob, wherein an outer diameter of the outlet port is the same as the diameter of the dedendum circle of the external lob, wherein the inner diameter of the inlet port is less than the inner diameter of the outlet port, and wherein the outer diameter of the inlet port is greater than the outer diameter of the outlet port.

2. The electric pump claim 1, wherein the motor housing and the pump housing are integrally formed, and wherein the pump housing comprises a shaft hole through which the shaft passes.

3. The electric pump claim 2, wherein a thickness of an inner wall formed from the shaft hole to an inner circumference surface of the inlet port is 15% to 25% of a diameter of the shaft hole.

4. The electric pump claim 1, wherein the inlet port and an inner side of the dedendum circle of the internal lob have an overlap region in the axial direction, wherein the inlet port and an outer side the dedendum circle of the external lob have an overlap region in the axial direction, wherein the cover comprises an oil ring groove into which an oil ring is inserted.

5. The electric pump claim 1, wherein the cover comprises an oil ring and an oil ring groove into which the oil ring is inserted, wherein a thickness of an outer wall formed from the oil ring groove to an outer circumference surface of the inlet port is greater than or equal to a thickness of the oil ring groove.

6. The electric pump claim 1, wherein the cover comprises an inlet communicating with the inlet port and an outlet communicating with the outlet port.

7. The electric pump claim 6, wherein the inlet and the outlet face the internal rotor and the external rotor.

* * * * *